US010584947B1

(12) United States Patent
Manley et al.

(10) Patent No.: US 10,584,947 B1
(45) Date of Patent: Mar. 10, 2020

(54) DRAG SEPARATING REDUCED DISPERSION PUSHER

(71) Applicant: U.S. Government as Represented by the Secretary of the Army, Picatinny Arsenal, Dover, NJ (US)

(72) Inventors: David Chalfant Manley, Hackettstown, NJ (US); Thomas Michael Presutti, Jr., Long Valley, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/677,484

(22) Filed: Aug. 15, 2017

Related U.S. Application Data

(60) Provisional application No. 62/444,974, filed on Jan. 11, 2017.

(51) Int. Cl.

| | |
|---|---|
| ***F42B 7/04*** | (2006.01) |
| ***F42B 7/10*** | (2006.01) |
| ***F42B 12/64*** | (2006.01) |
| ***F42B 10/38*** | (2006.01) |
| ***F42B 12/56*** | (2006.01) |
| ***F42B 14/06*** | (2006.01) |
| ***F42B 12/72*** | (2006.01) |

(52) U.S. Cl.
CPC ..... *F42B 7/043* (2013.01); *F42B 7/046* (2013.01); *F42B 7/10* (2013.01); *F42B 10/38* (2013.01); *F42B 12/56* (2013.01); *F42B 12/64* (2013.01); *F42B 12/72* (2013.01); *F42B 14/06* (2013.01); *F42B 14/065* (2013.01)

(58) Field of Classification Search
CPC .... F42B 7/04; F42B 7/043; F42B 7/08; F42B 7/10; F42B 10/38; F42B 12/56; F42B 12/58; F42B 12/64; F42B 14/06; F42B 14/065; F42B 7/046
USPC ..... 102/457, 448, 449, 520, 521, 522, 523
See application file for complete search history.

(56) References Cited

U.S. PATENT DOCUMENTS

| | | | | |
|---|---|---|---|---|
| 3,180,265 | A * | 4/1965 | Rybak | F42B 7/08 102/451 |
| 3,730,095 | A * | 5/1973 | Lage | F42B 7/08 102/451 |
| 3,762,332 | A * | 10/1973 | Witherspoon | F42B 14/064 102/523 |
| 3,812,784 | A * | 5/1974 | Herter | F42B 7/08 102/451 |
| 3,991,682 | A * | 11/1976 | Peak | F42B 5/02 102/438 |
| 4,476,785 | A * | 10/1984 | Hoffman | F42B 14/067 102/522 |
| 4,750,425 | A * | 6/1988 | Sigg | F42B 14/064 102/351 |
| 5,012,744 | A * | 5/1991 | Sowash | F42B 14/064 102/439 |

(Continued)

FOREIGN PATENT DOCUMENTS

GB 2293869 A * 4/1996 ..... F42B 7/08

*Primary Examiner* — James S Bergin
(74) *Attorney, Agent, or Firm* — Michael C. Sachs

(57) ABSTRACT

A sub-projectile carrier which uses aerodynamic drag to delay the release of a payload in a tailorable manner to control the spread of the payload over a desired range. A 40 mm shotgun style cartridge is shown for use for counter unmanned aerial systems, and for short range anti-personnel applications.

22 Claims, 2 Drawing Sheets

(56) References Cited

U.S. PATENT DOCUMENTS

| | | | | | |
|---|---|---|---|---|---|
| 5,969,289 | A * | 10/1999 | Bisping | F42B 14/061 | 102/521 |
| 6,105,506 | A * | 8/2000 | Gangale | F42B 10/26 | 102/439 |
| 6,701,848 | B1 * | 3/2004 | Georgantzis | F42B 12/64 | 102/449 |
| 6,814,006 | B2 * | 11/2004 | Johansson | F42B 14/068 | 102/522 |
| 7,243,603 | B2 * | 7/2007 | Sheaffer | F42B 7/043 | 102/449 |
| 8,622,000 | B2 * | 1/2014 | Meyer | F42B 7/046 | 102/448 |
| 9,528,806 | B2 * | 12/2016 | Rossmann | F42B 14/06 | |
| 10,408,591 | B1 * | 9/2019 | Manley | F42B 14/065 | |
| 2015/0330754 | A1 * | 11/2015 | Bierman | F42B 7/00 | 102/522 |

* cited by examiner

DRAG SEPARATING REDUCED DISPERSION PUSHER

CROSS REFERENCE TO RELATED APPLICATIONS

This application claims benefit under 35 USC § 119 (e) from provisional application 62/444,974 filed Jan. 11, 2017, the entire file wrapper contents of which are hereby incorporated by reference as though fully set forth.

U.S. GOVERNMENT INTEREST

The inventions described herein may be made, used, or licensed by or for the U.S. Government for U.S. Government purposes.

BACKGROUND OF INVENTION

A 40 mm round is needed that would release sub-projectiles from its payload in a manner which controls the spread of the sub-projectiles for a desired range. Early design attempts to meet the needs previously discussed generated concepts similar to a traditional shotgun wad which rapidly releases its payload as it exits the muzzle of the weapon. Currently the only 40 mm solution to this need might seem to be an M576 round. The M576 was first developed as a close quarter solution for grenadiers in the Vietnam War. The cartridge was intended to disperse a payload of buckshot similar to a shotgun shell for use in close quarters and in environments where traditional 40 mm grenades would be ineffective such as shooting through brush. A problem with this cartridge is that the shot cup is designed to tumble in order to disperse the payload, causing a large spread of pellets at the target. Due to the need for an extended range solution this concept is seen as not feasible since the shot spreads too rapidly to be effective on a target. Even in a smooth bore shotgun barrel firing a shell with a traditional shotgun wad results in too great of a spread to be effective for the given ranges needed. The problem of spread also is exacerbated in weapons which have rifling, and shortness of barrels (such as the M203 and M320 barrels).

BRIEF SUMMARY OF INVENTION

According to this invention, a pusher can release sub-projectiles from its payload due to aerodynamic drag in a manner which controls the spread of the payload for a desired range. In this invention, a 40 mm shotgun style cartridge was created for use as a counter unmanned aerial system (UAS) application as well as for a short range anti-personnel (SRAP) application. However, the invention is also applicable in other projectile and ammunition applications where the release of sub-projectiles is required. This design can deliver a payload similar to that of a shotgun with increased precision yet at extended ranges. This design is very useful to counter UAS applications. In COUNTER UAS applications, a large area of coverage is needed to increase probability of hit, while a dense enough grouping is also needed to increase the probability of hitting a critical component of the UAS. This design is also useful for SRAP applications in order to increase the number of hits on the target.

This invention utilizes a saboted pusher which acts as an aerodynamic containment device which is intended to pull off of the payload, due to the aerodynamic drag, instead of releasing it rapidly. In this way the shot is contained until a much greater distance from the barrel, thus extending the effective range of the projectile. In addition to this, the pellets are released more cleanly and in a contained manner, causing the pellets to disperse from the shot line at a slower rate. This containment enables the cartridge to produce a more concentrated grouping of pellets at extended ranges.

The primary mechanism that is acting in this design is the combination of the momentum of the pusher and its aerodynamic shape, which together determine how quickly the pusher drags away from the shot column. By adjusting the mass of the pusher as well as its drag features it is possible to create a design which can be tailored to create a desired shot spread at a designated range. In the shotgun industry there are technologies which pertain to shot containment devices that release shot in a cylindrical manner. The main difference is that these concepts are still intended to pull off of the shot column rapidly in order to avoid the pusher going unstable. A feature of this invention is for a pusher which is aerodynamically stable with and without the pellets, and which is intended to fly with the payload for a greater distance instead of rapidly releasing its payload.

As may be seen in the figures below a tail feature has been incorporated into the pusher to create a greater drag profile for the round in order to cause the pusher to pull off of the shot column. This tail, or other such aerodynamic features, can be customized in order to tailor the level of drag seen by the projectile, thereby determining the payload dispersing distance. The tail is also intended to generate aerodynamic stability allowing the pusher to fly in a stable manner with Increased accuracy. Since the payload remains in the pusher for an extended period it is important for the pusher to remain stable during flight until all of the payload has exited the pusher in order to maintain the tightest possible spread down range. The figures show a full projectile assembly with sabots and a closure lid. The pusher is the component of this design that acts as the drag separating component. The sabot shown is a multi-piece discarding sabot which is used to guide and to help propel the sub-caliber pusher down the barrel. The sabots are also used to reduce the spin imparted to the pusher due to their minimal contact with the barrel. The sabots are held together by a crimped cartridge case until firing. After firing, the sabots are contained with the pusher due to the keying feature in the pusher until the projectile exits the barrel and the sabots discard due to their light weight and also due to air forces acting on them. The closure lid snaps into a groove on the sabots and is used to retain the payload until firing. When the sabots discard the lid discards as well allowing the payload to exit the pusher freely at the desired range. The design shown is intended for 40 mm applications in the saboted form, however the principle of a pusher which flies a distance with its payload and relies solely on drag to release from its payload has applications to other calibers of ammunition including shotgun ammunition. In addition to this, the pusher itself, or the saboted concept can be scaled up to be used in larger calibers of ammunition. The geometry and material of the pusher can be adjusted for the payload and for aerodynamic effects including increasing drag, decreasing drag, moving the center of gravity, and altering various other components. In addition to this, the tail feature, which is currently used as a drag and stability mechanism, can also be adjusted or replaced with other stabilizing and drag inducing features. The pusher can be made to generate a tailored dispersal distance of its payload by adjusting its momentum and drag profile.

OBJECTS OF THE INVENTION

Accordingly, it is an object of the invention is to provide means for dispersing a payload from a carrier which relies solely on drag to release the payload from the carrier.

Another object of the invention is to provide means for dispersing a payload from a carrier which can be made to generate a tailored dispersal distance by adjusting the carrier's momentum and drag profile.

A further object of the invention is to provide a payload dispersing carrier wherein the geometry and material of the carrier and aerodynamic profile may be adjusted, including by increasing drag, decreasing drag, moving the center of gravity, or altering various other components.

It is a still further object of the invention to provide means for dispersing a payload from a carrier intended for 40 mm applications but which has applications to other calibers of ammunition including shotgun ammunition, and which can be scaled up to be used in larger calibers of ammunition.

It is yet another feature of this invention that the tail feature which is currently used as a drag and stability mechanism, can also be adjusted or replaced with other stabilizing and drag inducing mechanisms.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
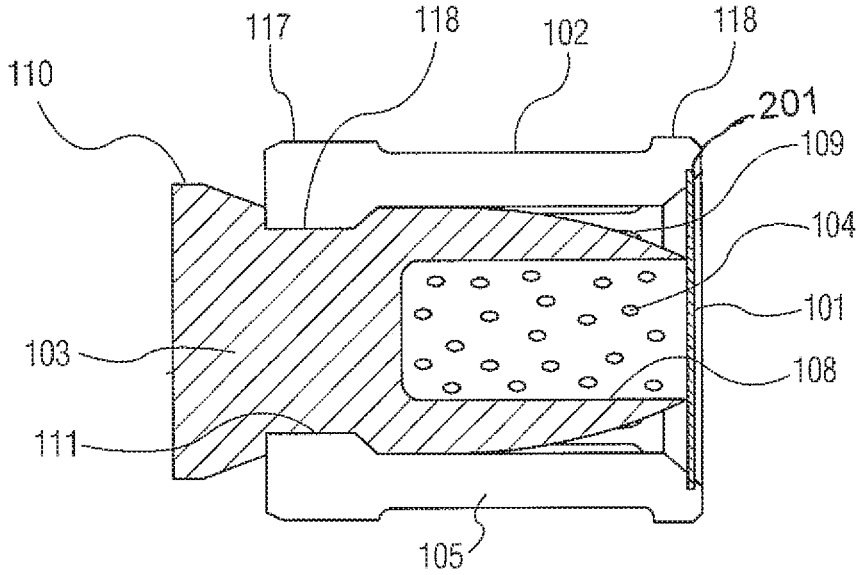
FIG. 1 is a cross sectional view of a drag dispersal shot round according to this invention.
Figure 2:
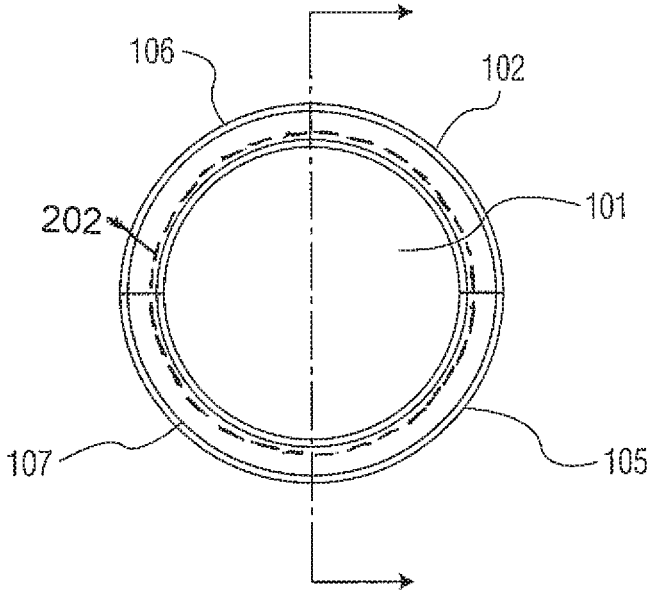
FIG. 2 shows a front end view of the drag dispersal shot round according to this invention.
Figure 3:
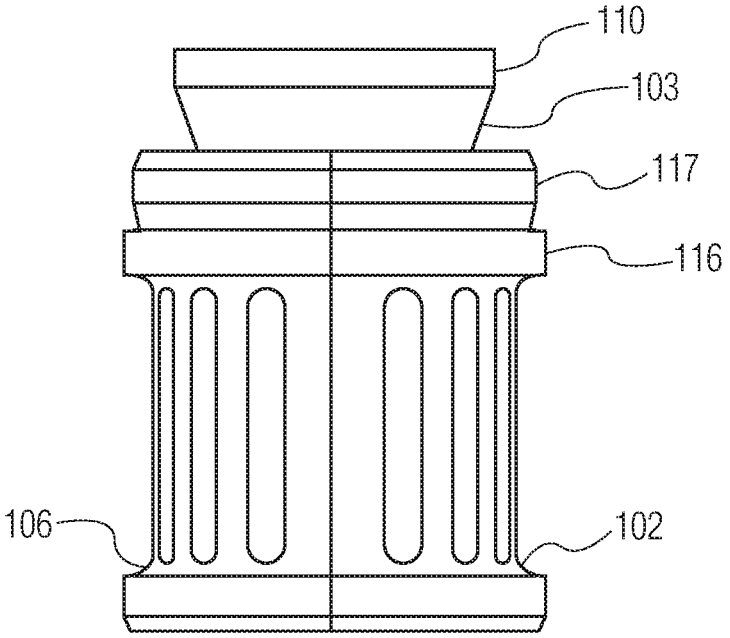
FIG. 3 illustrates an outer side view of an assembled drag dispersal shot round according to this invention.
Figure 4:
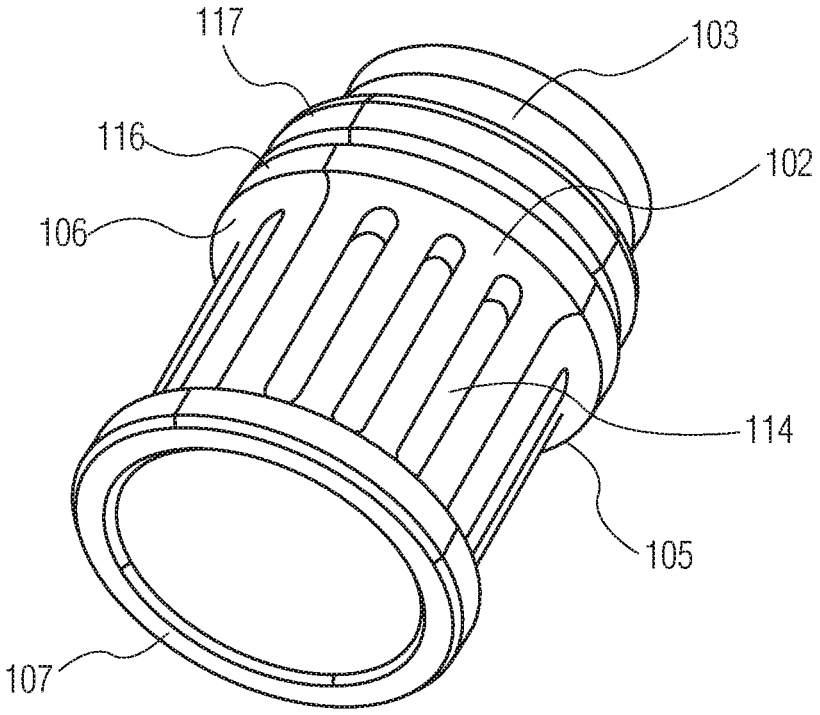
FIG. 4 shows a left downward looking isometric view of an assembled drag dispersal shot round according to this invention.

FIG. 1 shows a gunshot delivery system 100 according to this invention. The gunshot delivery system 100 is launched through a gun barrel (not shown). The gunshot delivery system 100 has a shot pellet containment device 103, which is mounted within a sabot device, which sabot device comprises four sabot petals 102, 105, 106 and 107. The gunshot delivery system and/or sabot may be made of plastics, metals, composites, or other suitable materials. The shot pellet containment device 103 may be made of various polymers or titanium or aluminum or steel or other materials. The shot pellet containment device 103 comprises a hollow cavity 108 which is used to contain pellets 104. The pellets may comprise round balls or cubes of steel, tungsten, titanium, magnesium, polymers or composites, or various alloyed metals, or other hard materials, they may include, subprojectiles, or they could include buckshot similar to a shotgun shell or rubber pellets or a powder substance, a liquid substance. The front end of the shot pellet containment device 103 is closed by a round shaped lid 101 which further contains the pellets. Round shaped lid 101 in held firmly in place by a groove 201 in the four sabot petals 102, 105, 106 and 107. Groove 201 shown in FIG. 1 and (partially) by hidden line circle 202 in FIG. 2, is a notch of rectangular cross section and annularly formed throughout all the sabots (102, 105, 106, and 107) sized to receive and hold lid 101 in position before and during launch. As may be described further, after firing, the mating boss on four sabot petals 102, 105, 106 and 107 are retained by the groove in the shot pellet containment device 103 and at muzzle exit are free to separate in flight due to onrushing air acting on the four sabot petals 102, 105, 106 and 107 further allowing the sabots to separate and the lid 101 to detach and drop away. Without lid 101, the pellets will become free to be dispersed. Dispersal may be over time as the gunshot delivery system 100 flies, or in flight to various degrees. The shot pellet containment device, payload 103 is aerodynamically shaped for flight. The front areas 109 are curved, while the aft end has a drag inducing flared out area 110 to slow the shot pellet containment device 103 in flight. There is a crimping means within the sabot petals 102, 105, 106 and 107 which holds the projectile assembly together, also the shot pellet containment device, 103 has recessed ring grooved areas 111 through which the sabot petals 102, 105, 106 and 107 may further grip the shot pellet containment device 103. FIG. 1 is a cross sectional view A-A taken along section lines A-A found in front end view FIG. 2. FIG. 4 shows an isometric view of the assembled gunshot delivery system 100 of this invention, with the front end pointing downward to the left. FIG. 3 is a side view of the assembled gunshot delivery system 100 of this invention. There are open longitudinal slots 114 in the sabot petals 102, 105, 106 and 107 in order to decrease the mass of the assembly however these openings are not essential. There are barrel like rings on the outside surface of the sabot(s) of this gunshot delivery system 100. As seen in FIG. 1, at the forward end of the sabot(s) there is a ring 118 and a ring 117 at the aft area of the sabot(s), which as shown in FIGS. 3 and 4 could be multiple rings such as 117 and 116. These rings are intended to stabilize the projectile as it travels down the surface. The rear ring is intended to be the same diameter as the forward ring to create a surface to ride the lands of the barrel, thereby decreasing spin. As may be seen, the saboted pusher 102, 105, 106 and 107 of this invention acts as a containment device that discards from the carrier 103 due to the force of the air and spin after the projectile exits the barrel. The payload containment lid is also discarded as it is released by the sabots discarding. The carrier and its payload then fly uninhibited until the drag forces on the carrier earlier cause it to slow down at a different rate from the payload. At this point the payload exits the carrier in a cylindrical manner. In this way the pellets are also contained until a much greater distance from the barrel, extending the effective range of the projectile and reducing the dispersion of the pellets. In addition to this the pellets 104 may be released more cleanly, and in a contained manner, causing the pellets to disperse from the shot line at a slower rate. The momentum of the carrier and the aerodynamic drag on the carrier determine how quickly and at what distance the payload will be released.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A gunshot delivery system round comprising:

a payload containment device which comprises a carrier which pulls off of its payload to release it, due to aerodynamic drag acting upon the carrier, thereby increasing the time and distance from launch where the payload is released to reduce its dispersion, wherein the round is a sub caliber projectile comprising multi-piece sabots which feature a groove (201) to retain a lid which contains the payload inside of the carrier, and which lid is released after launch of the round solely due to aerodynamic forces opening up the sabots, and wherein only release of said lid thereafter allows the payload to be released.

2. The round of claim 1 wherein the carrier's center of gravity, mass, aerodynamic profile can be altered to tailor the distance that the carrier releases its payload.

3. The round of claim 1 wherein the round is a sub caliber projectile comprising: multi-piece sabots further comprising longitudinally joined sabot petals which are sized to mate with an enclose the carrier.

4. The round of claim 1 wherein the round is a large caliber projectile.

5. The round of claim 1 wherein the round is a shotgun caliber projectile.

6. The round of claim 1 wherein the round features a carrier made of steer.

7. The round of claim 1 the round features a carrier made of aluminum.

8. The round of claim 1 wherein the round features a carrier made of titanium.

9. The round of claim 1 wherein the round features a carrier made of magnesium.

10. The round of claim 1 wherein the round features sabots made of steel.

11. The round of claim 1 wherein the round features sabots made of aluminum.

12. The round of claim 1 wherein the round features sabots made of titanium.

13. The round of claim 1 wherein the round features sabots made of magnesium.

14. The round of claim 1 wherein the round features a payload of round balls of steel.

15. The round of claim 1 wherein the round features a payload of round balls of tungsten.

16. The round of claim 1 wherein the round features a payload of cubes of tungsten.

17. The round of claim 1 wherein the round features a payload of round balls of rubber.

18. The round of claim 1 wherein the round features a payload of cubes of rubber.

19. The round of claim 1 wherein the round features a payload of round balls of polymer or composite.

20. The round of claim 1 wherein the round features a payload of cubes of polymer or composite.

21. The round of claim 1 wherein the round features a payload of a powder substance.

22. The round of claim 1 wherein the round features a payload of a liquid substance.

* * * * *